US010849396B2

(12) United States Patent
Magalde et al.

(10) Patent No.: US 10,849,396 B2
(45) Date of Patent: Dec. 1, 2020

(54) SECURE UMBRELLA STORAGE ACCESSORY

(71) Applicants: Rodolfo Magalde, Miami, FL (US); Cristina Magalde, Miami, FL (US)

(72) Inventors: Rodolfo Magalde, Miami, FL (US); Cristina Magalde, Miami, FL (US)

( * ) Notice: Subject to any disclaimer, the term of this patent is extended or adjusted under 35 U.S.C. 154(b) by 0 days.

(21) Appl. No.: 16/562,419

(22) Filed: Sep. 5, 2019

(65) Prior Publication Data

US 2020/0253344 A1 Aug. 13, 2020

Related U.S. Application Data

(60) Provisional application No. 62/804,367, filed on Feb. 12, 2019.

(51) Int. Cl.
*A45B 25/18* (2006.01)

(52) U.S. Cl.
CPC ..... *A45B 25/18* (2013.01)

(58) Field of Classification Search
CPC ..... A45B 25/18; A45B 2200/1054
See application file for complete search history.

(56) References Cited

U.S. PATENT DOCUMENTS

| | | | | | |
|---|---|---|---|---|---|
| 1,204,804 | A * | 11/1916 | McGowan | A45B 25/18 | 135/33.2 |
| 2,681,070 | A | 6/1954 | Dippolito | | |
| 4,154,255 | A | 5/1979 | Weaver | | |
| 4,336,817 | A | 6/1982 | Shapiro | | |
| 4,978,110 | A * | 12/1990 | Lin | A45B 3/04 | 135/33.4 |
| 5,441,064 | A | 8/1995 | Becker | | |
| 6,083,114 | A * | 7/2000 | Bailey | A63B 57/357 | 473/196 |
| 9,763,501 | B2 * | 9/2017 | Supino | A45B 3/00 | |
| 2006/0011226 | A1 * | 1/2006 | Santos | A45B 23/00 | 135/33.2 |
| 2008/0283102 | A1 | 11/2008 | Kelley | | |

* cited by examiner

*Primary Examiner* — Noah Chandler Hawk
(74) *Attorney, Agent, or Firm* — Runyan Law; Charles Runyan

(57) ABSTRACT

A storage receptacle for an umbrella; the storage receptacle includes a receptacle-body, at least one access-aperture, at least one fastener, and at least one attachment-means. The receptacle-body is translucent or transparent, and flexible to allow the storage receptacle to collapse with the umbrella. The storage receptacle is useful for secure storage of items within the umbrella.

19 Claims, 5 Drawing Sheets

SECURE UMBRELLA STORAGE ACCESSORY

CROSS REFERENCE TO RELATED APPLICATION

The present application is related to and claims priority to U.S. Provisional Patent Application No. 62/804,367 filed Feb. 12, 2019, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of storage receptacles and more specifically relates to a secure storage receptacle for an umbrella.

2. Description of Related Art

When engaging in recreational activities, it is sometimes desirable to have an umbrella to protect oneself from excessive exposure to sunlight and/or precipitation. An umbrella is convenient because it provides a lightweight, easily positionable shield to the sun or other weather. As umbrellas are often used in conjunction with active summer activities, such as swimming, it may be inconvenient for a user engaged in these activities to carry many items with them. Often, users may leave items unattended beneath an umbrella. This leaves items vulnerable to being lost or stolen. A suitable solution is desired.

U.S. Pub. No. 2008/0283102 to Thomas Jeffrey Kelley relates to a beach umbrella with storage space. The described beach umbrella with storage space includes a storage space or compartment in the interior of the umbrella for the storage of valuables and sundries. The storage space is formed on the underside of the canopy of the umbrella by a piece of fabric secured at its outer edges to the juncture of the umbrella's canopy ribs and stretcher ribs and at its center to the operating runner that slides up and down on the umbrella center pole. A secure opening accommodates inserting sundry articles into and removing them from the space between the canopy and the fabric. The umbrella has the appearance of a standard umbrella and folds and expands in conventional manner yet provides a convenient storage space for valuables and sundries.

BRIEF SUMMARY OF THE INVENTION

In view of the foregoing disadvantages inherent in the known storage receptacles art, the present disclosure provides a novel secure umbrella storage accessory. The general purpose of the present disclosure, which will be described subsequently in greater detail, is to provide secure storage of items within an umbrella system.

A storage receptacle is disclosed herein. The storage receptacle includes a receptacle-body which may include an outer-shell defining a storage-capacity. The outer-shell may be made from a material that at least partially allows light to pass through, such that a user may be able to view content(s) of the storage-capacity. At least one access-aperture may be in the receptacle-body and is configured to provide access to the storage-capacity. At least one fastener may be configured to selectively close and selectively open the at least one access-aperture. Further, at least one attachment-means may be attached to the receptacle-body; the attachment-means configured to removably attach the receptacle-body to an inner-surface of a canopy.

A method of using the storage receptacle is also disclosed herein. The method of using the storage receptacle may comprise the steps of: providing the storage receptacle as above; opening the umbrella; removably attaching the receptacle-body to the inner-surface of the canopy via the attachment-means; opening the at least one access-aperture via the at least one fastener; placing at least one item into the storage-capacity; and closing the at least one access-aperture via the at least one fastener.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a secure umbrella storage accessory, constructed and operative according to the teachings of the present disclosure.

The various embodiments of the present invention will hereinafter be described in conjunction with the appended drawings, wherein like designations denote like elements.

DETAILED DESCRIPTION

Figure 1:
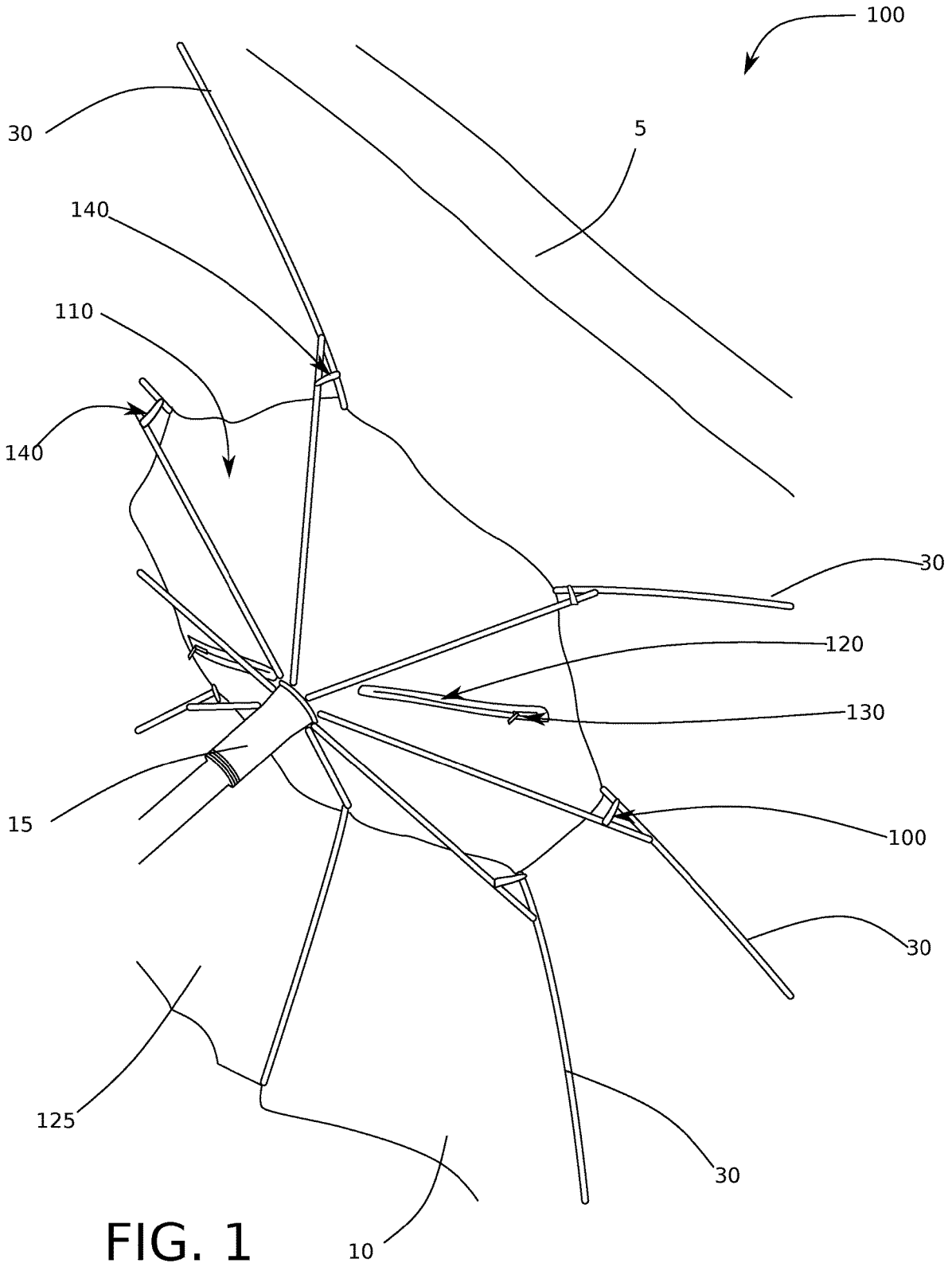
FIG. 1 is a bottom side perspective view of the storage receptacle, according to an embodiment of the disclosure.

As discussed above, embodiments of the present disclosure relate to storage receptacles and more particularly to a secure umbrella storage accessory as used to improve the secure storage.

Generally, disclosed is a storage receptacle for attachment to an umbrella and for securing personal belongings such as cell phone(s), wallet(s), sunglasses, etc. therein and concealing them from view. The storage receptacle may include two zippers (zipping fasteners) for allowing access into the storage receptacle.

The storage receptacle may be made from a material that is (partially/substantially) transparent and visible to the individual resting in a lounge chair underneath the umbrella, and not visible to others. The material may also be flexible/foldable to allow the storage receptacle to open and close with the umbrella. However, the storage receptacle may also be easily removed if desired.

The storage receptacle may include a sheet, at least one access mechanism, and a plurality of fasteners. The sheet may be a 'net' or other fabric member able to be stretched out beneath the umbrella. The plurality of fasteners may fasten the sheet to the umbrella. The sheet may be divided by a channel passing radially from the center of the sheet to the edge of the sheet. This channel enables the sheet to be passed around a center shaft of an umbrella. The channel may further include a central void able to circumscribe the shaft of the umbrella. Preferably, the channel may be narrow enough so that the sheet is substantially circular when disposed beneath the umbrella.

In some embodiments, the exterior perimeter may include a reinforced border which strengthens the sheet. In one embodiment, the sheet may have an octagonal perimeter. Other shapes may be used as well.

The at least one access mechanism may be a zipper (zipping fastener) and may be integrated into the sheet. Preferably, two access mechanisms are included. The access mechanisms may be opened to allow access into the space between the sheet and the umbrella. Items may be placed into this space, as shown, such that they may rest upon the sheet. In some embodiments, the access mechanisms may include security features, such as a lock, to prevent unauthorized personnel from accessing the contents of the accessory.

The sheet may further include a top sheet and a bottom sheet. The top sheet and the bottom sheet may be joined around the perimeter edge, such that the accessory includes an enclosed storage cavity. This design is advantageous in that it prevents stored items from falling out of the cavity, and improved security. The items may be retained within the accessory even if the accessory is removed from the umbrella.

The plurality of fasteners may affix to ribs of the umbrella. In this way, the sheet may be suspended beneath the ribs. For umbrellas having ribs that are spaced from the umbrella web, the sheet may be supported above the ribs. Preferably, the sheet is circular and may be positionable concentrically to the umbrella web. The plurality of fasteners may be clips (or the like) having a hinged or spring member for releasably securing each clip around the umbrella support. One embodiment may include eight fasteners. Other quantities of fasteners may be used.

Referring now more specifically to the drawings by numerals of reference, there is shown in FIGS. 1-5, various views of a storage receptacle 100.

FIG. 1 shows a storage receptacle 100 during an 'in-use' condition, according to an embodiment of the present disclosure. As illustrated, the storage receptacle 100 may include a receptacle-body 110, at least one access-aperture 120, at least one fastener 130, and at least one attachment-means 140. The storage receptacle 100 may be attachable to an umbrella 5. The umbrella 5 may include a canopy 10 and a pole 15 at a center thereof, the canopy 10 having an inner-surface 25, and plurality of foldable-ribs 30 attached to the inner-surface 25. Preferably, the umbrella 5 may be a beach or pool umbrella.

Figure 2:
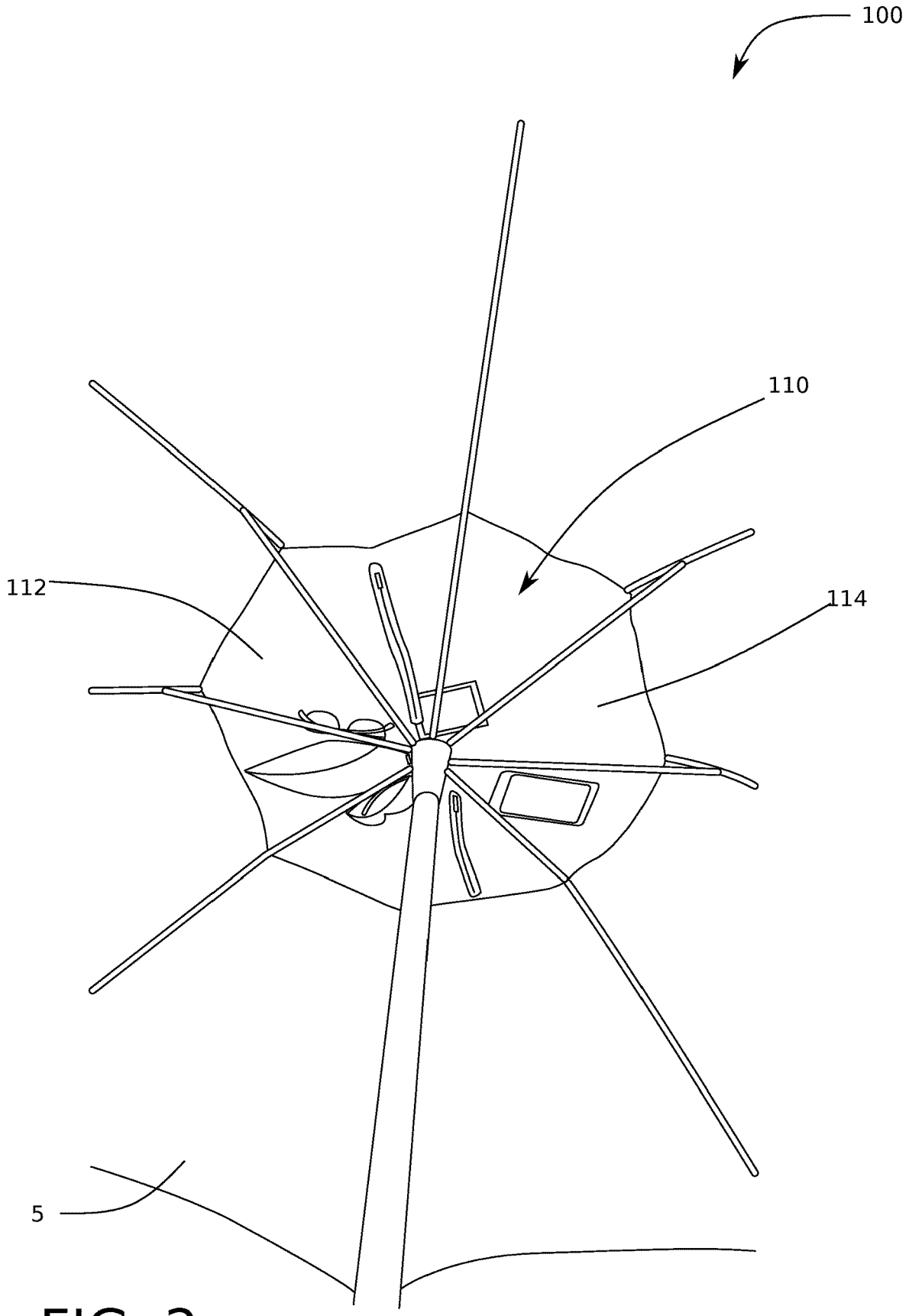
FIG. 2 is a bottom perspective view of the storage receptacle of FIG. 1, according to an embodiment of the present disclosure.

FIG. 2 shows a bottom perspective view of the storage receptacle 100 of FIG. 1, according to an embodiment of the present disclosure. The receptacle-body 110 may include an outer-shell 112 defining a storage-capacity 114. The storage-capacity 114 may be configured to store items, particularly personal belongings such as cell phones, sunglasses, wallets, etc. Preferably, the outer-shell 112 may be made from a material that at least partially allows light to pass through, such that a user is able to view at least one content of the storage-capacity 114. The material may be translucent, allowing some light through, but not all; or may be transparent, allowing most light through. A user may be able to view the content(s) of the storage-capacity 114 whilst sitting or lying underneath the umbrella 5.

Preferably, the material may be flexible. Further, the material may be foldable and configured to permit folding of the storage-receptacle when the umbrella 5 is in a collapsed-position, such that the receptacle-body 110 is able to move with the umbrella 5. In one embodiment, the material may be a fabric material. The fabric material may be a net, mesh, or web. In other embodiments, the material may be a plastic.

The receptacle-body 110 may include a substantially circular configuration. However, other shapes are contemplated, such as octagonal, hexagonal, etc. to conform to the shape of the umbrella 5. Further, the receptacle-body 110 may include a pole-aperture 116 at a center thereof, configured to allow passage of the pole 15 therethrough.

Figure 3:
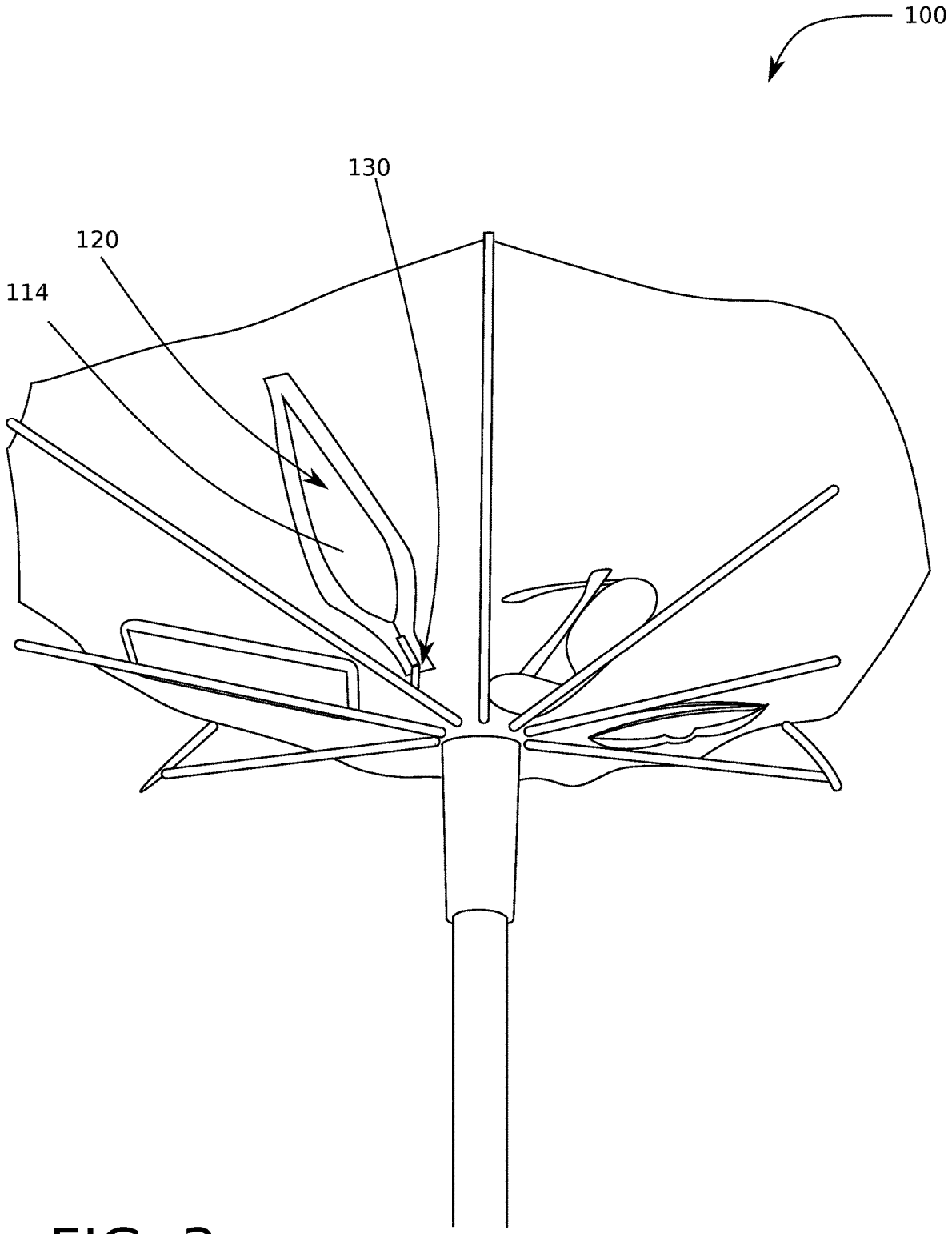
FIG. 3 is a front bottom perspective view of the storage receptacle of FIG. 1, according to an embodiment of the present disclosure.

FIG. 3 shows a front bottom perspective view of the storage receptacle 100 of FIG. 1, according to an embodiment of the present disclosure. At least one access-aperture 120 may be in the receptacle-body. The at least one access-aperture 120 may be configured to provide access to the storage-capacity 114. In one embodiment, the at least one access-aperture 120 includes two access-apertures. The two access-apertures may be located on opposite sides of the receptacle-body. Further, at least one fastener 130 may be configured to selectively close and selectively open the at least one access-aperture. Preferably, the at least one fastener 130 is a zippable fastener 130. In addition, each of the two access-apertures may include one zippable fastener 130. It should be appreciated that other fasteners are contemplated such as buttons, hook and loop fastener, snap fasteners, etc.

Figure 4:
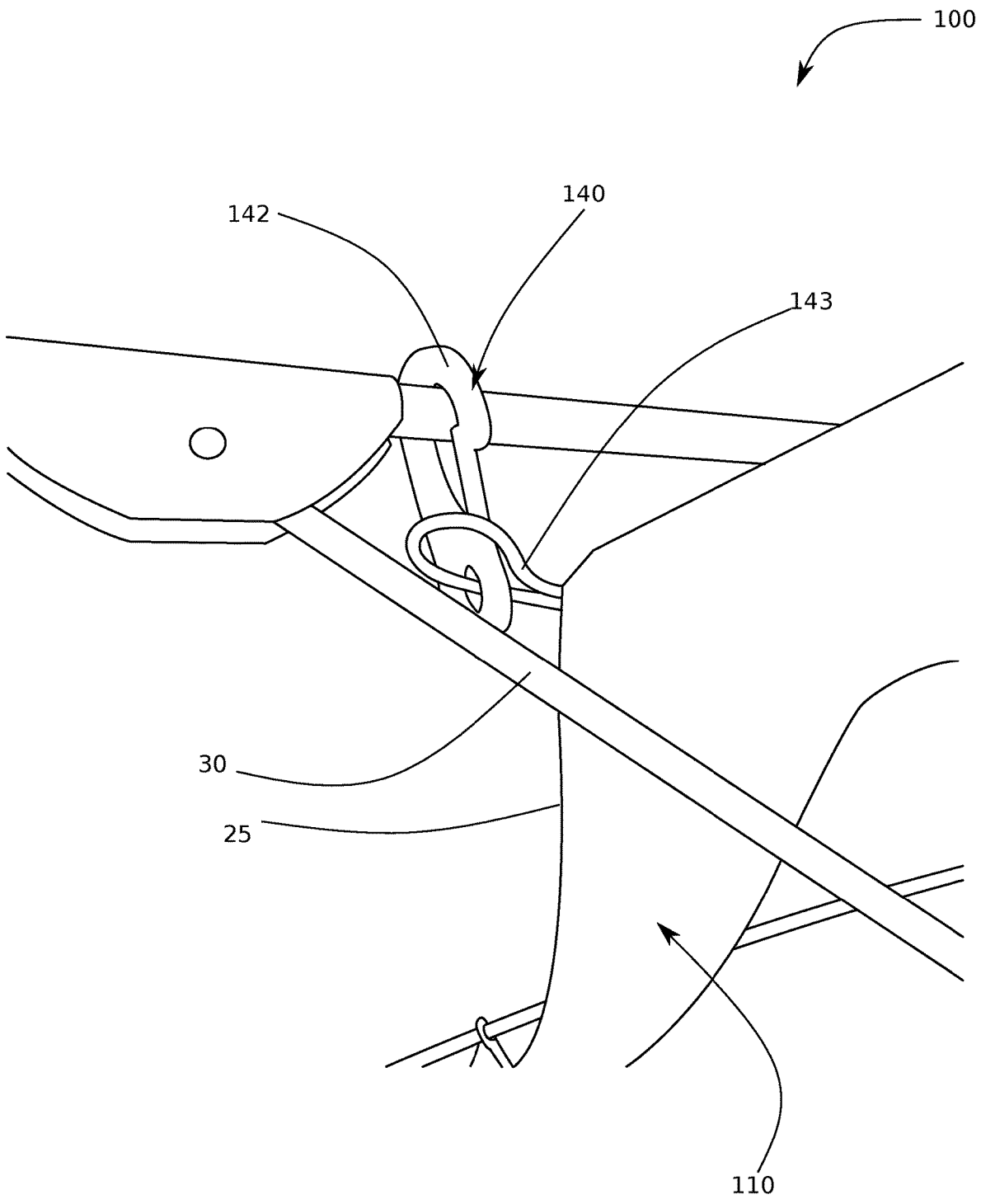
FIG. 4 is a front perspective view of the storage receptacle of FIG. 1, according to an embodiment of the present disclosure.

FIG. 4 shows a front perspective view of the storage receptacle 100 of FIG. 1, according to an embodiment of the present disclosure. At least one attachment-means 140 may be attached to the receptacle-body 110 and configured to removably attach the receptacle-body 110 to the inner-surface 25 of the canopy. In one embodiment, the at least one attachment-means 140 may be at least one clip 142. In another embodiment, the at least one attachment-means 140 may also include at least one hook 143. Preferably, the at least one clip 142 may be a plurality of clips, and the at least one hook 143 may be a plurality of hooks. Particularly, in one embodiment, eight clips 142 may be used.

In one embodiment, each of the plurality of clips may be configured to removably attach to at least one of the plurality of foldable ribs 30. In this embodiment, the plurality of clips 142 may be distributed about a periphery of the receptacle-body 110.

As above, the storage-capacity 114 (FIG. 2) may be configured to store items such as cell phones, sunglasses, wallets, etc. In one embodiment, the attachment-means 140 may be configured to support the storage-receptacle 100 having a storage-capacity weight of about 5 lb. In another embodiment, the attachment-means 140 may be configured to support the storage-receptacle having a storage-capacity weight of between about 5-10 lb. It should however be appreciated that the storage-capacity weight is not limited to 10 lb.

Figure 5:
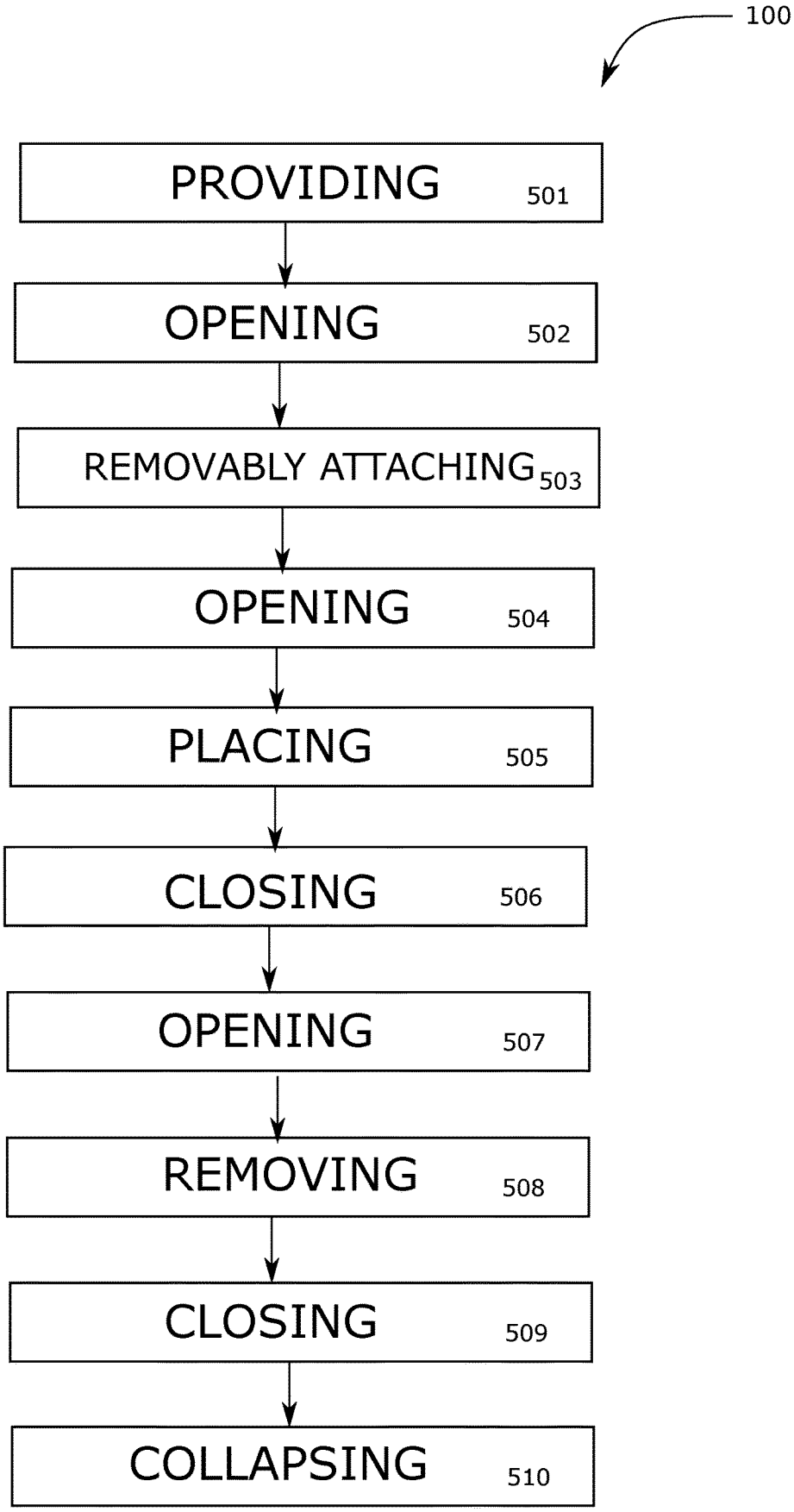
FIG. 5 is a flow diagram illustrating a method of use for the storage receptacle, according to an embodiment of the present disclosure.

FIG. 5 is a flow diagram illustrating a method of using a storage receptacle for an umbrella 500, according to an embodiment of the present disclosure. As illustrated, the method of using a storage receptacle for an umbrella 500 may include the steps of: 501 providing the storage receptacle as above; 502 opening the umbrella; 503 removably attaching the receptacle-body to the inner-surface of the canopy via the attachment-means; 504 opening the at least one access-aperature via the at least one fastener; 505 placing at least one item into the storage-capacity; and 506 closing the at least one access-aperture via the at least one fastener. Further steps may include: 507 opening the at least one access-aperture via the at least one fastener; 508 removing the at least one item into the storage-capacity; 509 closing the at least one access-aperture via the at least one fastener; and 510 collapsing the umbrella.

It should be noted that steps 507, 508, 509 and 510 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for storage receptacle 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A storage receptacle for an umbrella, the umbrella including a canopy and a pole at a center thereof, the canopy having an inner-surface, and plurality of foldable-ribs attached to the inner-surface, the storage receptacle comprising:

a receptacle-body including an outer-shell defining a storage-capacity, the outer-shell being made from a material that at least partially allows light to pass through, such that a user is able to view a content of the storage-capacity;

at least one access-aperture in the receptacle-body, the at least one access-aperture configured to provide access to the storage-capacity;

at least one fastener configured to selectively close and selectively open the at least one access-aperture; and at least one clip attached to the receptacle-body configured to removably attach the receptacle-body to the inner-surface of the canopy.

2. The storage receptacle of claim 1, wherein the material that at least partially allows light to pass through is translucent.

3. The storage receptacle of claim 2, wherein the material is flexible.

4. The storage receptacle of claim 3, wherein the material is foldable and configured to permit folding of the storage-receptacle when the umbrella is in a collapsed-position.

5. The storage receptacle of claim 1, wherein the material is a fabric material.

6. The storage receptacle of claim 1, wherein the at least one clip is a plurality of clips.

7. The storage receptacle of claim 6, wherein the plurality of clips is distributed about a periphery of the receptacle-body.

8. The storage receptacle of claim 7, wherein each of the plurality of clips are configured to removably attach to at least one of the plurality of foldable ribs.

9. The storage receptacle of claim 1, wherein the receptacle-body includes a substantially circular configuration.

10. The storage receptacle of claim 1, wherein the receptacle-body includes a pole-aperture at a center thereof, configured to allow passage of the pole therethrough.

11. The storage receptacle of claim 1, wherein the clip is configured to support the storage-receptacle having a storage-capacity weigh of at least 5 lb.

12. The storage receptacle of claim 1, wherein the clip is configured to support the storage-receptacle having a storage-capacity weigh of between 5-10 lb.

13. The storage receptacle of claim 1, wherein the at least one fastener is a zippable fastener.

14. The storage receptacle of claim 1, wherein the at least one access-aperture includes two access-apertures.

15. The storage receptacle of claim 14, wherein each of the two access-apertures includes one zippable fastener.

16. The storage receptacle of claim 1 wherein the outer shell comprises a top sheet and a bottom sheet wherein the top sheet is joined to the bottom sheet around the perimeter of the outer shell.

17. A storage receptacle for an umbrella, the umbrella including a canopy and a pole at a center thereof, the canopy having an inner-surface, and plurality of foldable-ribs attached to the inner-surface, the storage receptacle comprising:

a receptacle-body including an outer-shell defining a storage-capacity, the outer-shell being made from a material that at least partially allows light to pass through, such that a user is able to view a content of the storage-capacity;

at least one access-aperture in the receptacle-body, the at least one access-aperture configured to provide access to the storage-capacity;

at least one fastener configured to selectively close and selectively open the at least one access-aperture;

and at least one attachment-means attached to the receptacle-body, the attachment-means configured to removably attach the receptacle-body to the inner-surface of the canopy;

and wherein the material that at least partially allows light to pass through is translucent;

wherein the material is flexible;

wherein the material is foldable and configured to permit folding of the storage-receptacle when the umbrella is in a collapsed-position;

wherein the material is a fabric material;

wherein the at least one attachment-means is at least one clip;

wherein the at least one clip is a plurality of clips;

wherein the plurality of clips are distributed about a periphery of the receptacle-body;

wherein each of the plurality of clips are configured to removably attach to at least one of the plurality of foldable ribs;

wherein the receptacle-body includes a substantially circular configuration;

wherein the receptacle-body includes a pole-aperture at a center thereof, configured to allow passage of the pole therethrough;

wherein the attachment-means is configured to support the storage-receptacle having a storage-capacity weigh of at least 5 lbs.;

wherein the at least one fastener is a zippable fastener;

wherein the at least one access-aperture includes two access-apertures; and wherein each of the two access-apertures includes one said zippable fastener.

18. A method of using a storage receptacle for an umbrella, the umbrella including a canopy and a pole at a center thereof, the canopy having an inner-surface, and plurality of foldable-ribs attached to the inner-surface, the method comprising the steps of:

providing the storage receptacle for the umbrella including:

a receptacle-body including an outer-shell defining a storage-capacity, the outer-shell being made from a material that at least partially allows light to pass through, such that a user is able to view a content of the storage-capacity;

at least one access-aperture in the receptacle-body, the at least one access-aperture configured to provide access to the storage-capacity;

at least one fastener configured to selectively close and selectively open the at least one access-aperture;

and at least one clip attached to the receptacle-body configured to removably attach the receptacle-body to the inner-surface of the canopy;

and opening the umbrella;

removably attaching the receptacle-body to the inner-surface of the canopy via the clip;

opening the at least one access-aperture via the at least one fastener;

placing at least one item into the storage-capacity;

and closing the at least one access-aperture via the at least one fastener.

19. The method of claim 18, further comprising the steps of:

opening the at least one access-aperture via the at least one fastener;

removing the at least one item into the storage-capacity;

closing the at least one access-aperture via the at least one fastener; and collapsing the umbrella.

* * * * *